United States Patent [19]

Ospelt

[11] 4,378,837

[45] Apr. 5, 1983

[54] HEAT EXCHANGER

[75] Inventor: Gustav Ospelt, Vaduz, Liechtenstein

[73] Assignee: Hoval Interliz AG, Vaduz-Neugut, Liechtenstein

[21] Appl. No.: 120,161

[22] Filed: Feb. 11, 1980

[30] Foreign Application Priority Data

Feb. 15, 1979 [DE] Fed. Rep. of Germany ..... 2905732

[51] Int. Cl.[3] ..... F28F 3/10

[52] U.S. Cl. ..... 165/166; 29/157.3 R

[58] Field of Search ..... 165/157, 166, 167; 29/157.3 R

[56] References Cited

U.S. PATENT DOCUMENTS

| | | | |
|---|---|---|---|
| 2,181,597 | 1/1939 | Cross | 165/166 X |
| 2,368,814 | 2/1945 | Fagan | 165/157 X |
| 4,099,928 | 7/1978 | Norback | 165/166 |

FOREIGN PATENT DOCUMENTS

| | | | |
|---|---|---|---|
| 2523151 | 4/1976 | Fed. Rep. of Germany . | |
| 2631962 | 1/1977 | Fed. Rep. of Germany . | |
| 2533490 | 10/1977 | Fed. Rep. of Germany | 165/166 |
| 580039 | 8/1924 | France | 165/166 |
| 1384460 | 2/1975 | United Kingdom . | |
| 1528864 | 10/1978 | United Kingdom . | |

*Primary Examiner*—William R. Cline
*Assistant Examiner*—Theophil W. Streule, Jr.
*Attorney, Agent, or Firm*—Martin A. Farber

[57] ABSTRACT

A heat exchanger comprising a rectangular exchanger pack which consists of a plurality of individual, mutually spaced, foil-type plates which have triangular corner notches and are connected with one another in sealed manner on marginal strips which extend between the corner notches in pairs on two opposite plate margins for the formation of alternately crossing flow-through passages between the plates, and comprising a frame housing surrounding the exchanger pack comprising two covers disposed adjacent the outer plates of the exchanger pack and four struts connecting the covers at their corners. The marginal strips to be connected of each two adjacent plates of the exchanger pack rest flatly upon each other and are mechanically connected with each other by folding over at least once. The struts of the frame housing define a triangular recess on their side facing the edge of the exchanger pack. The pack edges with the corner notches project into these recesses. The recesses on the struts are filled out with a sealing filling made of a moulding resin to beyond the corner notches.

1 Claim, 3 Drawing Figures

HEAT EXCHANGER

The invention relates to a heat exchanger having a rectangular exchanger pack consisting of a plurality of individual, mutually spaced, foil-type plates which have triangular shaped corner notches and are connected with one another in sealed manner on the marginal strips extending between the clipped-out corner notches, by pairs at two opposite plated edges, to form alternately mutually crossing throughflow passages between the plates, and having a frame housing surrounding the exchanger pack, which housing consists of two covers lying adjacent the outer plates of the exchanger pack and four struts connecting the covers at their corners.

In the plate-type heat exchanger according to German Offenlegungschrift OS 25 21 351 and OS 25 33 490, the cross-flow exchanger pack consists of a single thin-walled strip, for example aluminum foil, cut to shape and folded in a special manner, where each two adjacent plates stick together and are connected by a common folded edge at one plate margin and at the opposite plate margin are bent towards one another and connected in sealed manner with one another along their line of contact by an adhesive connection. In this case the difficulty has arisen of adhering the plate margins with one another in such a way that the plate margins, held together only by the adhesive connection, cannot come apart and no leakages of the throughflow passages of the exchanger pack can occur. It has proved relatively expensive to cut the strip to shape and to fold it in such a way that the plates are spaced from one another and in connection with this the margins of a plate which meet in one plate corner are crimped to opposite sides for the formation of the common fold edge with the one adjacent plate and for the formation of the adhesive connection with the other adjacent plate. In this folding of the strip, triangular notches or clipped-out portions arise at the edges of the exchanger pack. In order to seal the crossing throughflow passages from one another at the edge of the pack, triangular sealing strips made of an elastic material, which engage in sealing manner in the clipped-out portions, are arranged on that side of the struts of the frame housing which faces the pack edge. It has proved difficult to obtain a durably elastic and satisfactorily sealing effect of the sealing strips, for example, under extreme temperature effects or in the case of aggressive media. Another heat exchanger of the initially stated type is known for example from the U.S. Pat. No. 1,635,838, where the exchanger pack consists of individual plates stacked one upon the other. The plates possess triangular clipped-out notches at their corners, so that marginal strips of the plates arise, which strips extend between the corner notches, which are bent off in alternating sequence and bent towards one another in pairs and come into contact at the margins. In the case of this heat exchanger the plates are clamped together by a plurality of clamping screws penetrating the exchanger pack, in order to hold together and compress the plate margins which are curved towards one another, and a welding of the mutually contacting plate edges is necessary in order to obtain a satisfactory sealing of the throughflow passages. The struts of the frame housing have an approximately rectangular cross-section and extend with an edge of its profile cross-section into the corner notches of the plates. In order to separate the mutually crossing throughflow passages from one another in sealed manner at the pack edges, a sealed welding-in of the profile edge of the struts is necessary in the corner notches of the plates. The production of this heat exchanger is also cumbersome and expensive.

The invention provides a heat exchanger of the kind as initially stated, the production of which is simpler and cheaper and in which nevertheless the sealing of the throughflow passages of the exchanger pack along the plate margins and along the pack edges, and respectively, the frame housing struts is stable, reliable and durable. The formation of the heat exchanger in accordance with the invention resides in that the marginal strips to be connected of each two adjacent plates of the exchanger pack rest flatly one upon the other and are mechanically connected with one another by at least one folding over in the manner that the struts of the frame housing have a triangular recess on their side facing the edge of the exchanger pack, into which there project the pack edge with the corner notches of the plates and the depth of which recess is greater than the depth of the corner notches, and that the recesses in the struts are filled out to over the corner notches with a sealing filling made of moulding resin.

The invention will be explained in greater detail below by reference to an embodiment example on the basis of the drawing. There:

Figure 1:
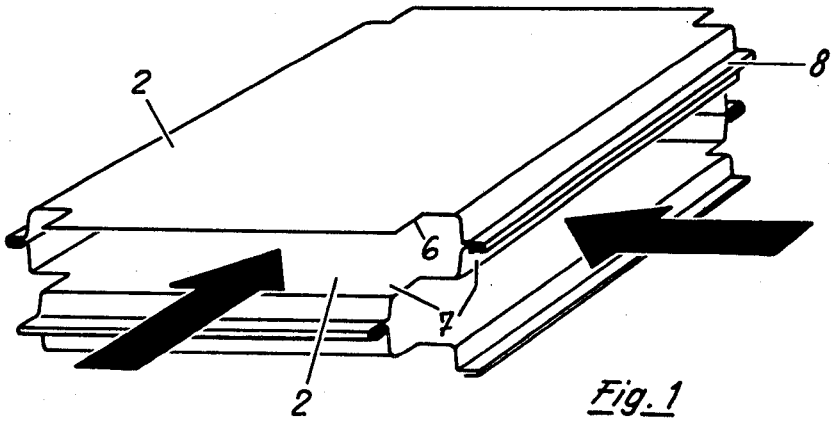
FIG. 1 shows a part of the exchanger pack, in perspective representation.
Figure 2:
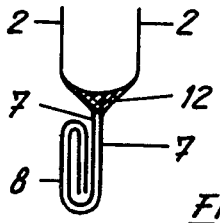
FIG. 2 shows the marginal strip connection of two plates, in cross-section.
Figure 3:
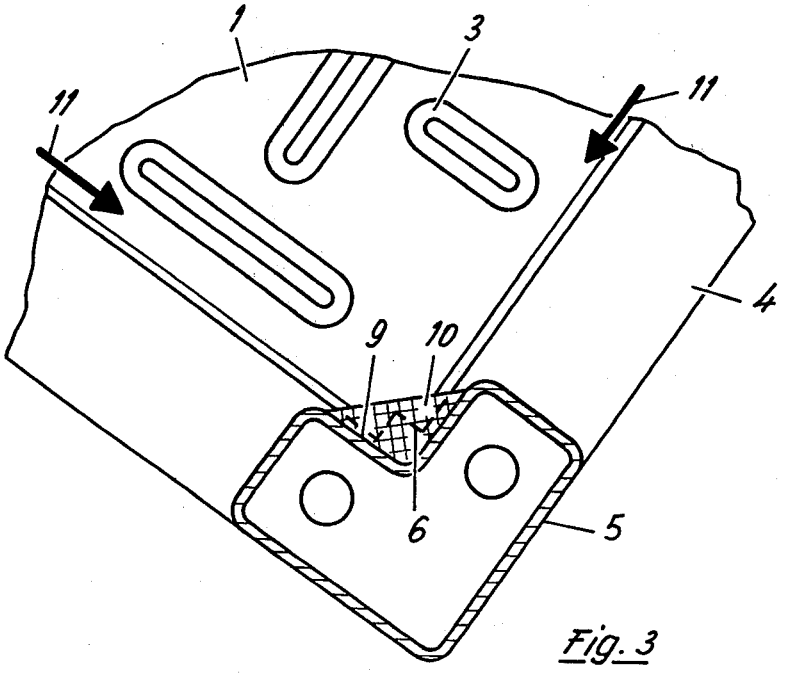
FIG. 3 shows a section, extending parallel to the plates, through a part of the exchanger pack and of the frame housing.

The rectangular exchanger pack 1 of the heat exchanger comprises a plurality of individual plates 2 stacked one upon the other, of which three plates are illustrated in FIG. 1. The plates 2 are punched or stamped out from a thin-walled material, for example, an aluminum foil. The plates 2 have pressed-in spacer ribs 3 which hold the plates at a desired distance from one another. The exchanger pack 1 is surrounded by a frame housing which comprises two covers 4 lying adjacent the two outer plates of the exchanger pack, and four struts 5 connecting the covers at their corners. The plates 2 are provided with triangular notches 6 at their corners. Thus marginal strips 7 of the plates 2 arise which extend between the corner notches 6 and the two marginal strips of a plate which respectively in each case run together into a corner notch can be bent over to opposite sides, as may be seen from FIG. 1. The depth of the corner notches 6, taking into account of the spacing of the plates, is dimensioned so large that the marginal strips 7 of two adjacent plates 2, which strips are bent towards one another, not only contact at their margins, but also, as illustrated by FIG. 1, lie flat upon one another and can be folded over together at least once. Due to this folding over portion 8, which can be produced very simply with a roller folding machine, the plates are mechanically connected with one another at their marginal strips and thereby held together firmly as well as in sealed manner. The marginal strips 7, as shown by FIG. 2, preferably are connected with one another by folding over twice, as double fold, whereby a particularly high strength or rigidity and satisfactory sealing of the plate margin connection are achieved. The plates 2 are connected with one another in alternate sequence on opposite plate margins or marginal strips, respectively, so that there arise flow-through passages of a cross-flow exchanger pack, which passages cross one another in alternate sequence. The struts 5 of the frame housing are provided on their side facing the edge of the exchanger pack 1 with a triangular recess 9. The opposite pack edge with the corner notches 6 of the plates 2 projects into the recess 9 of a strut 5. The depth of the recess 9 is dimensioned greater than the depth of the corner notches 6, as FIG. 3 shows. The recess 9 is sealed or filled by casting with a sealing filling 10 made of a moulding resin, preferably a quick-setting synthetic plastics moulding resin material. Since the depth of the recess 9 is greater than the depth of the clipped-out corner portions or notches 6, the recess 9 can be filled up with the sealing filler 10 to beyond the corner notches 6. Thus the pack edge is connected to the struts 5 absolutely sealed, so that the openings of the through-flow passages which openings lie to the left of the strut 5 in FIG. 3, for the one medium, are satisfactorily separated and sealed off from the openings of the through-flow passages for the other medium, which openings lie to the right of the strut 5. The filling by casting of the recesses 9 with the moulding resin-sealing filling 10 is effected in the production of the heat exchanger preferably in a manner such that in the tilted position of the exchanger pack as illustrated in FIG. 3, the quick-setting moulding resin is poured from above, as indicated by the arrows 11 in FIG. 3, into those intermediate spaces between the plates 2, which spaces are closed in FIG. 3 to the bottom left and to the bottom right by the foldings 8 of the marginal strips. The moulding resin runs out of these intermediate spaces at the corner notches 6 and fills the recess 9 to beyond the corner notches 6. During the pouring of the moulding resin from the top into these intermediate spaces, the moulding resin flows along on the inner side of the folds 8, so that in this way the gap between the individual plates 2 on the inner side of the fold location is also simultaneously filled with the quick-setting moulding resin, as represented with the reference character 12 in FIG. 2. This is of great advantage, since in this manner no capillary gaps remain between the plates 2 at the folds 8, at which gas corrosion phenomena could occur in the case of aggressive media.

I claim:

1. In a heat exchanger having an exchanger pack which comprises a plurality of individual foil-type rectangular plates spaced from one another, said plates define edges and at their corners at corner pack edges thereof have triangular corner notches between which marginal strips of said plates extend, said plates in pairs at two oppositely-lying plate edges flatly lie one upon the other with said marginal strips extending between said corner notches forming alternately crossing flow-through passages between said plates and [by folding over] at said marginal strips the plates are connected with one another, a frame housing surrounding the exchanger pack, said frame housing comprising two covers which are disposed adjacent outer plates of the exchanger pack and four struts connecting the covers at their corners, said struts being operatively connected in sealing fashion with the corner pack edges of the exchanger pack which corner pack edges contain the corner notches of the plates, [the improvement wherein] the struts [(5)], on sides thereof facing the corner pack edges of the exchanger pack [(1)] which corner pack edges contain the corner notches [(6)]of the plates [(2)], [are] being formed with a triangular recess [(9)], the improvement wherein said triangular recess having a depth greater than the depth of the corner notches, [and]

said corner pack edges with the corner notches as well as with the ends of the respectively connected said marginal strips [(7)], adjacent to the corner notches, of the plates, project into said recesses, respectively, and a sealing filling [(10)] fills up said recesses [(9)] on said struts up to beyond said corner notches [(6)], said triangular recess constitutes a mold form for sealing said sealing filling both to said struts and to said corner pack edges with the corner notches as well as with the ends of the respectively connected said marginal strips when said exchanger pack is mounted in said frame housing, said sealing filling [(10) being made] consisting of a molding resin which is poured into the [recesses after mounting of] mold form with the exchanger pack mounted in the frame housing.

* * * * *